United States Patent [19]

Mattson

[11] 4,334,657

[45] Jun. 15, 1982

[54] DEVICE FOR FIN-STABILIZED SHELL OR THE LIKE

[75] Inventor: Kjell Mattson, Karlskoga, Sweden

[73] Assignee: Aktiebolaget Bofors, Bofors, Sweden

[21] Appl. No.: 87,835

[22] Filed: Oct. 24, 1979

Related U.S. Application Data

[63] Continuation of Ser. No. 876,090, Feb. 8, 1978, abandoned.

[30] Foreign Application Priority Data

Feb. 9, 1977 [SE] Sweden ..... 7701406

[51] Int. Cl.[3] ..... F42B 13/32

[52] U.S. Cl. ..... 244/3.28; 102/473; 102/520

[58] Field of Search ..... 102/93, 56 R, 56 SC; 244/3.28

[56] References Cited

U.S. PATENT DOCUMENTS

| | | | |
|---|---|---|---|
| 2,613,605 | 10/1952 | Brandt | 102/56 SC |
| 2,730,046 | 1/1956 | Bergstrom et al. | 102/56 SC |
| 2,737,888 | 3/1956 | Brandt | 102/56 SC |
| 2,940,391 | 6/1960 | Brandt | 244/3.28 |

FOREIGN PATENT DOCUMENTS

| | | | |
|---|---|---|---|
| 2311271 | 12/1976 | France | 102/56 SC |
| 578995 | 7/1946 | United Kingdom | 102/56 SC |

*Primary Examiner*—Harold J. Tudor

*Attorney, Agent, or Firm*—Pollock, Vande Sande & Priddy

[57] ABSTRACT

A fin-stabilized projectile assembly including a nose section, a middle section and a tail section attached to one another, wherein said middle section includes a cylindrically-shaped forward end portion and a tapered rear end portion. A plurality of fins are mounted on the tail section, with fins engaging the projectile at a junction formed by the middle and tail sections, respectively.

7 Claims, 4 Drawing Figures

DEVICE FOR FIN-STABILIZED SHELL OR THE LIKE

This is a continuation of application Ser. No. 876,090, filed Feb. 8, 1978, now abandoned.

BACKGROUND OF THE INVENTION

The present invention relates to an improved short finstabilized shell, projectile, etc., of the type including a nose section, middle section, and tail section.

A purpose of the present invention is to create a design of a shell which, notwithstanding its short length, makes it possible to utilize the shell or the like for supersonic speeds (1 Mach and more), while maintaining a high degree of accuracy at the target.

A unique feature of the invention invention which mades it possible to achieve the desired goal is that the middle section of the shell or the like is made with a substantially straight and distinct guidance part and connected with this and the tail section a short tapered part arranged so that the guidance part has its junction with the tapered part via a large relief angle.

SUMMARY OF THE INVENTION

A shell formed according to the present invention exhibits outstandingly good exit ballistics at its exit from the muzzle of the barrel used, which contributes towards comparatively little yawing of the shell in its tragectory, thereby ensuring the good precision at the target. Further advantages are gained in that the centre of pressure is positioned toward the rear in the shell body as compared to prior art shell assemblies, which involves possibilities of moving the centre of gravity in a rearward direction. This, in turn, allows that the ballast to be reduced, thereby allowing the percental share of the effective charge in the shell in the total weight of the shell to be increased. The shell or the like utilizing the invention, as regards the location of the centre of gravity and centre of pressure, will be particularly suitable for having a so-called hollow-charge effect.

A short length of high-velocity ammunition also provides advantages from the points of view of storage and handling.

In a further development of the concept of the invention, the fins utilized on the shell or the like are made with fin sections which are extensible or can be turned out, which further contributes towards the moving rearwards of the centre of pressure and centre of gravity, resulting above-mentioned advantages.

BRIEF DESCRIPTION OF THE DRAWINGS

A preferred embodiment of the invention will be described in the following, with reference to the accompanying drawings, in which.

DETAILED DESCRIPTION OF THE PREFERRED EMBODIMENT

Figure 1:
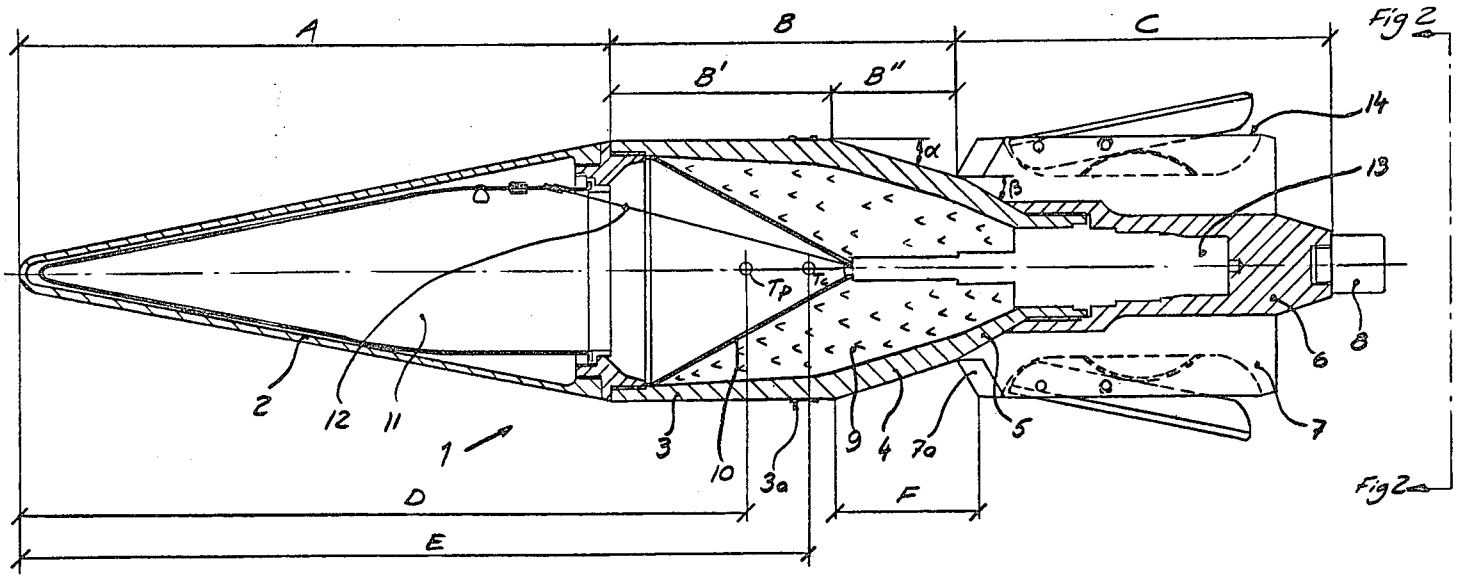
FIG. 1 shows a longitudinal section of a high-explosive shell utilizing the invention.

FIG. 1 is intended to illustrate a high-explosive shell 1 designed for a so-called hollow-charge effect, which is known in itself. The shell according to the example of the embodiment is intended to constitute a supersonic shell. Within the scope of the invention, the shell can, of course, also be utilized for lower flight speeds.

In accordance with FIG. 1, the shell is made with a nose section 2, which externally has the form of an elongate conical part. The shell also comprises a middle section which consists of a straight, distinct guidance part 3, which externally has the form of a cylinder, and also a short tapered part 4 which externally has the form of a first truncated cone. The guidance part 3 has its junction with the tapered part via an angle $\alpha$, which in this connection is considered to be a large angle and which forms the so-called relief angle. Finally, the shell has a tail section which is formed by a junction part 5 and a unit with a centre part 6. A plurality of fins 7 protrude straight upwards from part 6 and extend in the longitudinal direction of the shell. The junction part 5 is connected to tapered part 4 at its one end, where it essentially has the form of a second truncated cone, the cone angle $\beta$ of which is greater than the cone angle $\alpha$ of the first truncated cone. At its other end, the junction part 5 joins a cylindrical part on to which unit 5 can be screwed to center part 6 via threads. Fins 7 extend somewhat past the forward end portion of centre part 6. Undersurfaces of the sections extending past on the fins in the position when applied to the cylindrical part of the junction part of the unit will be in contact with the envelope surface of said second truncated cone. At their front ends, the fins have oblique surfaces 7*a* which form straight edges. The centre part 6 of the unit is substantially of uniform thickness, apart from a slight widening at the portion which coacts with the cylindrical part in the tail section. At the rear, behind the fins 7 the centre part is conical, and at an end surface of this conical part the centre part supports a tracer 8, which is known in itself, and which is arranged so that it can be screwed into the centre part.

In FIG. 1, among other things, the lengths of the various sections of the shell have been indicated. Thus, the length of the nose section is indicated by A, the length of the middle part by B and the length of the guidance part by C. On the middle part, the guidance part 3 has a length of B′ and a tapered part has a length of B″.

Internally, the shell comprises a space for a load 9 in the form of a main charge, a hollow charge 10 with the specific shape for the function of a hollow-charge effect, and a front contact, which is known in itself, in the form of a lead 12, is arranged. At the rear, the shell is made with a space 13 for a fuse for the main charge of the shell. The fuse can be of a type which is known in itself, which is prepared for activation at the firing from the firearm utilized, and which is activated by means of the impact device 12 so that the main charge is initiated. The guidance part A driving band 3*a* is also arranged on the guidance part 3.

The material in the shell and its component parts can be of the kind which is conventional for ammunition of this kind. Through the design of the various parts of the shell and the material used, the centre of gravity Tp has been obtained at a distance from the point of the nose section indicated by D, while the centre of pressure Tc is located behind Tp at a distance from said point of E.

Figure 3:
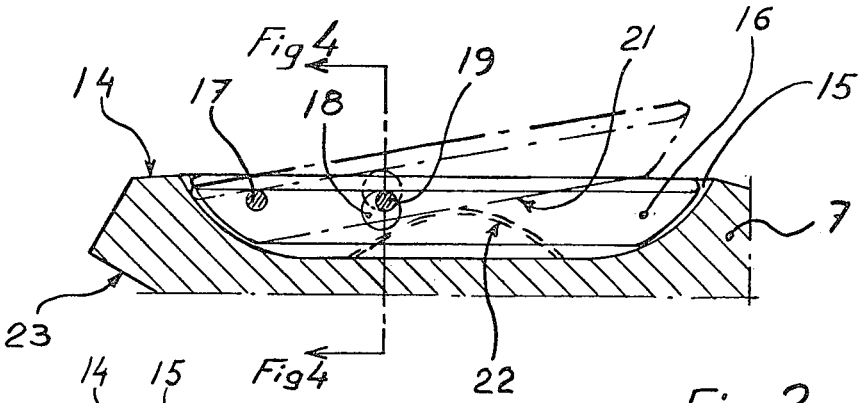
FIG. 3 shows a longitudinal section and enlargement of a fin arranged on the shell shown in FIGS. 1 and 2.
Figure 4:
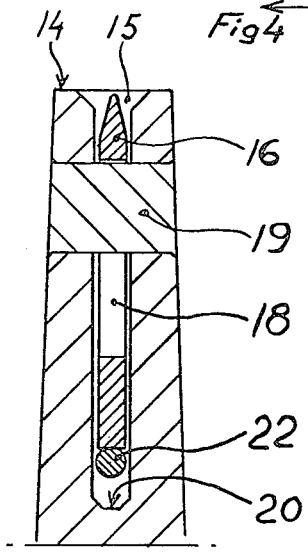
FIG. 4 shows a cross section of the fin according to FIG. 3.
Figure 2:
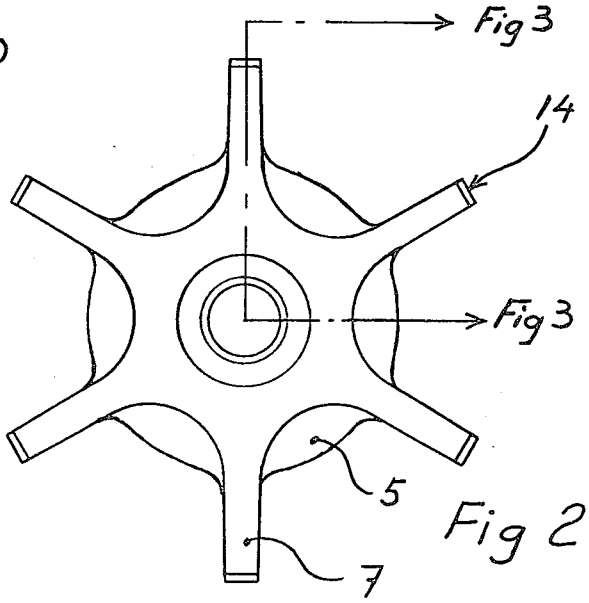
FIG. 2 shows an end view from the rear of the shell formed according to FIG. 1.

In accordance with FIG. 2, the unit 6 comprised in the tail section has fins 7 (main fins) equally spaced around the periphery. As shown in FIG. 3, each of these fins is made with a recess 15 arranged from the upper edge 14 of the fin in the material of which the fin is made. In said recess a fin blade 16 (additional fin) is extensibly arranged, rotatably supported at its one end on a supporting pin 17 fastened to the walls of the recess, i.e. in the material of which the fin 7 is made. The fin section 16 is moreover made with a recess 18 somewhat to the rear of its middle parts. An additional supporting pin 19 extends through said recess, and the size of the recess 18 exceeds the cross section of the pin 19. The degree of extension (the degree of turning out) of the fin blade 16 is thus determined by means of the recess 18 and the pin 19. In the recess 15 for the fin blade 16, between the bottom 20 of the recess and the lower edge side 21 of the fin blade a curved spring 22 is arranged, to permit the fin blade to be pressed down into the recess when the shell is in the barrel, and to achieve the pressing out of the fin blade to its extended position, which is indicated by dash lines in FIG. 3, when the shell leaves the barrel. The fins 7 have a thickness of approx. 4 mm, while the fin 16 has a thickness of approx. 1 mm. The supporting pins 17 and 19 consist of metal rivets arranged in the fins 7 which extend over the recess 15. In FIG. 3, the undersurfaces which can be in contact with the envelope surface of the second truncated cone are indicated by 23.

The upper edges 14 of the fins 7 are straight, and correspond to the full calibre of the shell, while the surfaces of the extended fin blades 16 which protrude above the upper edges will be located above the full calibre, which involves that the centre of pressure Tc will be farther to the rear in the shell and, accordingly, that the centre of gravity can be moved rearwards to the corresponding degree in relation to the case without extensible fin sections.

In addition to the embodiments shown of the nose section 2, the middle section 3, 4 and the tail section, also the internal dimensioning relations for these parts are of vital importance for obtaining the previously mentioned effects which are sought.

Thus, practical tests have shown that it is essential that the relief angle $\alpha$ be at least 10°, and should preferably be chosen within the raingе of 15°–20°, particular advantages then being obtained within such a narrow range as 17°±1°. The length B″ of the short tapered part 4 is between 40 and 90% of the calibre of the shell, and approx. 50% of the calibre should preferably be chosen. Like the fins, the guidance part corresponds to the full calibre from the point of view of diameter. In the present case, the calibre chosen is 90 mm, which gives a length of for instance the tapered part of approx. 45 mm. As the fins 7 which are made with straight upper edges 14 extend substantially to the rear parts of the tapered part, the above involves that a distance F between the rear end of the guidance part 3 and the front parts of the fins will be very small, which is of particular advantage for the exit of the shell from the barrel. When the guidance from the guidance part 3 ceases at said exit, the short length F involves that the fins will be capable of keeping the shell stabilized in the bore of the barrel until the shell has left the barrel entirely, which substantially reduces the tendency of the shell to yaw in its trajectory. This, in turn, gives improved precision at the target.

The length B′ of the guidance part and also the lengths of the upper edges 14 of the fins are essential. It has thus proved that the straight and distinct guidance part should have a length B′ which is 85–95%, preferably approx. 90%, of the full calibre of the shell, while the length of said upper edges 14 is substantially equal to said full calibre.

The length A of the nose section 2 which is conical externally is between 2.0–2.6 times the full calibre, preferably approx. 2.3 times said calibre.

The extensible fin blades 16 are arranged so that approx. one-half of the side surface of the respective fin section extends above the fin 7 to which it belongs when it is in the extended position. The fin blade 16 then also has such an extent and form that the distance between the ends of the fins 7 which are located highest on the fin blades on two diametrically opposite fins 7 is approx. 1.3 times the full calibre, which in accordance with the above is represented by the distance between the upper edge surfaces 14 of said two fins. Said fin blade extends along the substantial portion of said upper edge, and moreover has a height of approx. 12 mm.

The section of the junction part 5 which externally has the form of a second truncated cone has a length which is 25–32% of the full calibre. The oblique surfaces 7*a* of the fins at their front sections extend at the bottom counted straight rearwards from the connection point between said first and second truncated cones. The cone angle $\beta$ is approx. 25°–35°, preferably approx. 30°. The driving band 3*a* is located at the rear end of the guidance part 3, at a smaller distance from the junction to the tapered part. The total length (=A+B+C) of the shell is 4.5–5.25 times the full calibre, preferably approx. 4.8 times the full calibre of the shell.

In the example of the embodiment, the distance D to the centre of gravity is approx. 2.8 times the full calibre, while the distance E to the centre of pressure is approx. 3.0 times the full calibre. When fired, the fin-stabilized shell shown is given a comparatively low rotation, which decreases along the trajectory of the shell. Said spring 22 for the extensible fin blade 16 must then be made in such a way that it is capable of retaining the fin blade in the extended position, even at the low rotation speeds which occur.

The invention is not limited to the embodiment shown above as an example, but can be subject to modifications within the scope of the accompanying claims.

I claim:

1. A fin-stabilized projectile assembly adaptable for delivering a charge along a predetermined trajectory, and comprising:

a projectile body having a nose section, a middle section and a tail section, with said middle section including a substantially cylindrically-shaped forward end portion engaging said nose section and further including a tapered rear end portion extending between said cylindrically-shaped forward end portion and said tail section;

with said forward end portion extending substantially 85%–95% of the full caliber of said projectile;

an outer surface of said tapered rear end portion of said middle section forming an acute angle $\alpha$ with an imaginary plane extending parallel to said cylindrically-shaped forward end portion;

said tail section including a substantially cone-shaped forward end portion forming a direct juncture with said tapered portion of said middle section, said cone-shaped forward end portion forming an acute angle $\beta$ with a further imaginary plane extending parallel to said imaginary plane, wherein acute angle $\alpha$ is at least 15° and no larger than 20° and acute angle $\beta$ is greater than acute angle $\alpha$ to maintain a stable trajectory for said projectile; and separate elongated fin means each extending outwardly from said tail section, said fin means circumferentially spaced from one another about the periphery of said tail section, each of said fin means including a forward end portion overlapping said cone-shaped portion of said tail section, with each fin means having a forward edge extending outwardly from a position adjacent the juncture formed by said tapered portion of said middle section and said cone-shaped portion of said tail section for smoothly sweeping air between said elongated fin means to stabilize the projectile in its trajectory even during supersonic flight.

2. A fin-stabilized projectile according to claim 1, wherein said tail section includes a substantially cone-shaped forward end portion engaging said tapered rear end portion of said middle section, said tail section further includes a hollow central portion attached to and extending rearwardly from said cone-shaped forward end portion, with said hollow central portion being formed with a substantially uniform thickness.

3. A fin-stabilized projectile assembly according to claim 1, wherein said plurality of elongated fin means comprises a plurality of separate fin members evenly spaced about an outer periphery of said tail section, with each fin member extending in a direction substantially parallel to a longitudinal axis through said tail section.

4. A fin-stabilized projectile assembly according to claim 1, wherein said cylindrically-shaped forward end portion of said middle section is formed with an overall length which is 90% of the full caliber of said projectile assembly.

5. A fin-stabilized projectile assembly according to claim 1, wherein said tapered rear end portion of said middle section is formed with an overall length which is 50%–80% of the full caliber of said projectile assembly.

6. A fin-stabilized projectile assembly according to claim 1, wherein said nose section comprises a substantially conically-shaped member having a length substantially twice the full caliber of said projectile.

7. A fin-stabilized projectile assembly according to claim 1, wherein a separate slot is formed in a planar outer surface of each fin member, with an extendable blade pivotably mounted in each slot.

* * * * *